US005747741A

United States Patent [19]

Alsch

[11] Patent Number: 5,747,741

[45] Date of Patent: May 5, 1998

[54] SCREW TERMINAL FOR AN ELECTRICAL CONNECTION OF CABLES OR WIRES

[75] Inventor: Ing. Gottfried Alsch, Vienna, Austria

[73] Assignee: Hubert Laurenz Naimer

[21] Appl. No.: 640,053

[22] Filed: Apr. 30, 1996

[30] Foreign Application Priority Data

Jun. 16, 1995 [AT] Austria ..... 1034/95

[51] Int. Cl.[6] ..... H01R 4/34

[52] U.S. Cl. ..... 174/84 C; 439/812

[58] Field of Search ..... 174/84 C; 439/97, 439/98, 801, 806, 807, 813, 877, 882, 586, 812

[56] References Cited

U.S. PATENT DOCUMENTS

| | | | |
|---|---|---|---|
| 723,082 | 3/1903 | Turner | 439/801 |
| 1,979,582 | 11/1934 | Stolp | 439/801 |
| 2,231,868 | 2/1941 | Allen | 439/801 |
| 4,059,335 | 11/1977 | Simon | 339/272 UC |
| 4,531,797 | 7/1985 | Jullien et al. | 339/61 M |
| 4,830,627 | 5/1989 | Heng et al. | 439/586 |
| 5,249,989 | 10/1993 | Alsch | 439/812 |

FOREIGN PATENT DOCUMENTS

| | | |
|---|---|---|
| 144 990 | 11/1980 | German Dem. Rep. . |
| 31 13 676 | 10/1982 | Germany . |
| 283 878 | 4/1989 | Germany . |
| 647 101 | 12/1984 | Switzerland . |
| WO 91/17588 | 11/1991 | WIPO . |

*Primary Examiner*—Kristine L. Kincaid
*Assistant Examiner*—Chau N. Nguyen
*Attorney, Agent, or Firm*—Collard & Roe, P.C.

[57] ABSTRACT

A screw terminal for an electrical connection of an eye of a cable comprises a casing, a first clamping plate axially movably but not rotatably mounted in the casing, the axial movement of the first clamping plate being limited by an inner surface of the casing. The first clamping plate defines a taphole and has laterally bent up, axially extending spring tongues. A second clamping plate is fixedly mounted in the casing, the second clamping plate defining a taphole axially aligned with the tap hole in the first clamping plate. A clamping screw axially moves the first clamping plate between a closed position and an open position limited by the inner casing surface wherein the space between the first clamping plate and the second clamping plate has a maximum axial length. The clamping screw comprises a screwhead held in the open position between the spring tongues of the first clamping plate and an axially extending shaft passes first through the taphole of the first clamping plate and then through the taphole of the second clamping plate in the closed position. The shaft comprises a threaded section engaging the tapholes, a constricted neck between the screwhead and the threaded section, and a threadless free end having a diameter smaller than the diameter of the tapholes and an axial length not exceeding the thickness of the first clamping plate base section.

3 Claims, 3 Drawing Sheets

SCREW TERMINAL FOR AN ELECTRICAL CONNECTION OF CABLES OR WIRES

FIELD OF THE INVENTION

The invention relates to a screw terminal for an electrical connection of cables or wires, particularly such cables or wires fitted with a cable eye. Such a screw terminal generally comprises a casing and a clamping screw which penetrates a firs t clamping plate and also penetrates a second clamping plate when the terminal is closed, while remaining immerged in the first clamping plate when the terminal is open, thereby clearing the space between the first and the second clamping plate.

DESCRIPTION OF THE PRIOR ART

A screw terminal of the kind mentioned above has been known from the U.S. Pat. No. 5,249,989. In this known terminal, the first clamping plate, which is penetrated first by the clamping screw when the screw is screwed in place, is fixed in the casing and comprises a plain bore which is penetrated by the clamping screw. The second clamping plate is held axially movable but not rotatable.

Furthermore, a spring plate is arranged in the area of the first clamping plate, said spring plate comprising a bore surrounded by radial slits. The diameter of the bore is substantially equal to thee core diameter of the threaded shaft of the clamping screw.

The shaft of the clamping screw is reduced in a neck area adjacent to the screwhead and in an area adjacent to the free end of its threaded shaft to a diameter which is smaller than the inside diameter of the bores penetrated by the clamping screw. The axial length of the neck area at least equals the thickness of the section of the first clamping plate which is penetrated by the clamping screw, and the axial length of the threadless area adjacent to the free end of the screw is at maximum equal to the thickness of the area of the first clamping plate which is penetrated by the clamping screw. The width of opening of the two clamping plates is limited by an inner surface of the casing.

The length of the threaded shaft of the clamping screw is dimensioned in a way that, on the one hand, the spring plate lies in the threadless neck area of the clamping screw when the head of the clamping screw rests on the first clamping plate, thereby avoiding a locking of the thread, and that, on the other hand, the threaded shaft of the clamping screw is disengaged from the taphole of the second clamping plate when the terminal is completely opened only as the threaded shaft is already again engaged with the spring plate, resulting in the possibility to screw the clamping screw further out of the terminal in order to facilitate the insertion of a cable eye into the terminal.

The drawback of this known terminal lies in the effort required for the assembly of the terminal resulting to a considerable extent from the spring plate which has to be fixed to the first clamping plate.

SUMMARY OF THE INVENTION

It is the object of the present invention to avoid this disadvantage and to propose a screw terminal of the kind mentioned above which can be manufactured easily and assembled in a straightforward manner.

According to the invention, this goal is reached by arranging the first clamping plate, which is penetrated first by the clamping screw when the screw is screwed in place, axially movable but not rotatable in the casing while the second clamping plate is fixed in the casing, both clamping plates comprising aligned tapholes and the opening width of the two clamping plates being smaller than the length of the threaded shaft of the clamping screw. The first clamping plate comprises laterally bent up spring tongues which are provided for holding the head of the clamping screw in its position which corresponds to the open state of the terminal.

Through these proposed measures, a very straightforward construction of the terminal with a minimum number of components is made possible, and these components may also be very easily mounted in an according casing.

Owing to the shape of the screw and to the axial movability of the first clamping plate, a locking of the thread of the shaft of the clamping screw is securely prevented. It is also guaranteed that the terminal is opened and the two clamping plates are spread when the clamping screw is loosened or screwed out respectively. Thereby, a secure support of the clamping screw is assured by the laterally bent up spring tongues of the axially movable first clamping plate even when the clamping screw is screwed out of the second, fixed clamping plate.

In this context, it is advantageous if the two lateral tongues of the first clamping plate are shaped circularly in the cross section parallel to the second clamping plate in the area of their free ends.

It is advantegeous if the movable first clamping plate lies lower than the fixed second clamping plate in the fitting position of the terminal in order to ensure that both clamping plates remain in their fully opened positions even when they are acted upon by shock or vibrations. The terminal is thereby preferably mounted in a position in which the clamping screw runs sloping upwards, viewed from its head.

The insertion of a cable eye between the fixed contact and the movable contact is facilitated with the fixed clamping plate comprising at least on one side a beveling starting at the contact surface facing the movable clamping plate.

BRIEF DESCRIPTION OF THE DRAWING

The invention will now be explained in detail according to the drawing, in which.

DETAILED DESCRIPTION OF PREFERRED EMBODIMENT

Figure 1:
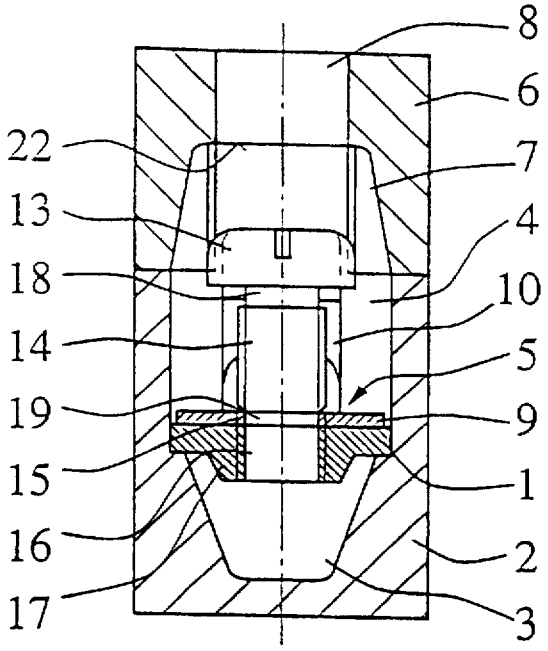
FIG. 1 and FIG. 2 show sections, in the longitudinal and transverse directions of the fixed contact, through a casing containing a screw terminal according the invention in the open state of the terminal.
Figure 2:
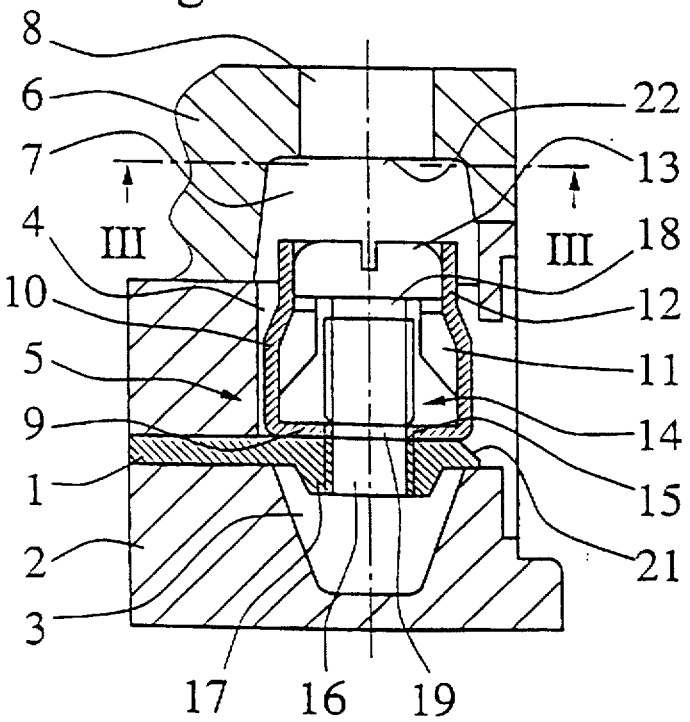
Figure 3:
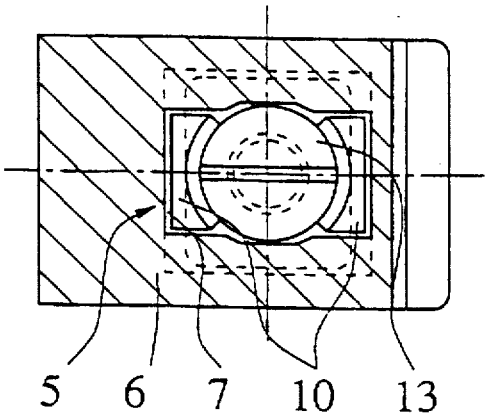
FIG. 3 shows a section along the line III-III through the screw terminal according to FIG. 1 and FIG. 2.

The FIGS. 1 through 3 show a screw terminal according the invention in a multipart casing. A fixed clamping plate 1 is held in a base body 2, a conical pit 3 being provided below the clamping area in the body 2. Above the fixed clamping plate 1 in the body 2, a clearance 4 is provided which is open to the outside of the body 2 and in which a movable clamping plate 5 is held axially movable but not rotatable. The clearance 4, as well as the movable clamping plate 5, which is penetrated first by a clamping screw 14 when the screw 14 is screwed in place, has a substantially rectangular cross section in the plane parallel to the fixed clamping plate 1.

The body 2 is roofed by a cover 6 which comprises a clearance 7 rectangular in cross section and divering toward the body 2 in the shape of a trough, clearance 7 being aligned substantially coaxially with the clearance 4 of the body 2. Furthermore, an assembly hole 8 ending in the clearance 7 is provided for inserting a screwdriver.

Figure 4:
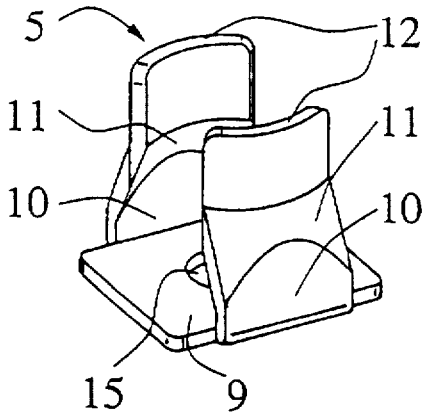
FIG. 4 shows an axonometric view of a movable clamping plate.

As can be seen in FIG. 4, the movable clamping plate 5 comprises a substantially flat clamping element 9 as well as two spring tongues 10 bent up along the longitudinal edges of the flat part 9. These spring tongues 10 comprise frusto-conical sections 11 and, circularly accurate sections 12, adjoining to these sections 11. The inner diameter of the cylindrical sections 12 is smaller than the diameter of the head 13 of the clamping screw 14 so that the screw 14 can be clampingly held in place when its screwhead 13 passes between sections 12 and pushes them apart.

The clamping screw 14 engages a taphole 15 of the movable clamping plate 5 and a taphole 16 of the fixed clamping plate 1, the fixed clamping plate 1 comprising a bulge 17 defining taphole 16.

The clamping screw 14 comprises a threadless neck 18 whose axial extension exceeds the thickness of the flat clamping part 9 of the movable clamping plate 5, and an end section 19 which is threadless as well, the diameter of these threadless sections being smaller than the inside diameter of the tapholes 15, 16. The length of the thread of the clamping screw 14 remaining between the two threadless sections 18, 19 is greater than the difference between the distance from the base 22 of the clearance 7 of the cover 6 to the side of the fixed clamping plate 1 facing the cover 6 and the height of the movable clamping plate 5, including its two tongues 10. The threadless section 19 of the clamping screw 14 has an axial extension which does not exceed the thickness of the clamping part 9 of the clamping plate 5.

Figure 5:
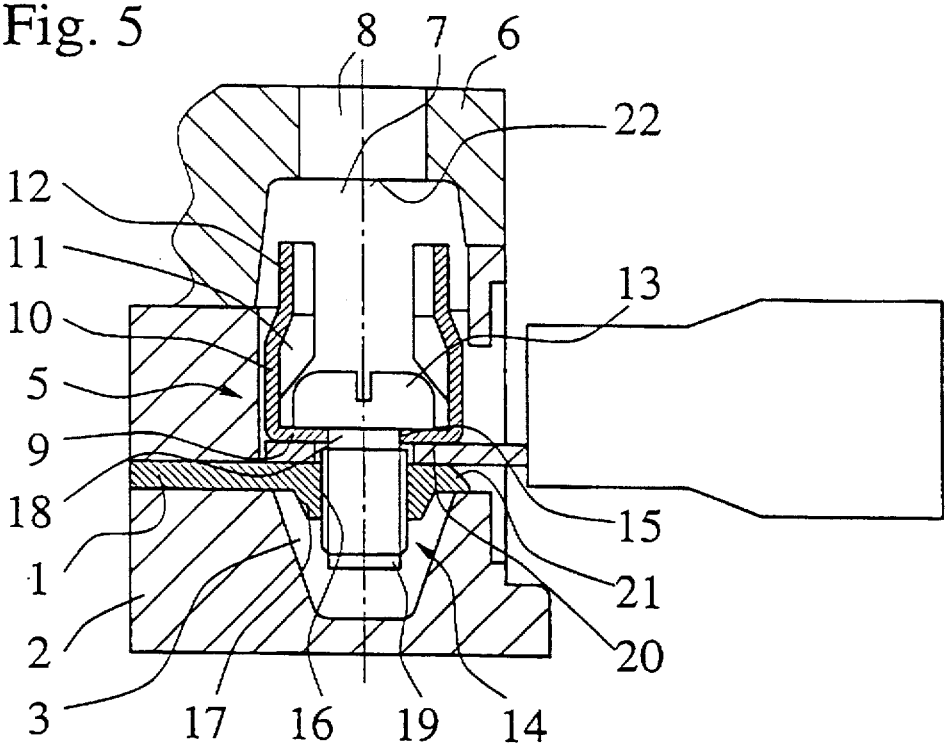
FIG. 5 shows a terminal with a clamped cable eye.

FIG. 5 shows a screw terminal according the invention with a clamped cable eye 20, the insertion of the cable eye 20 between the clamping plates 1 and 5 being facilitated by the beveling 21 of the fixed clamping plate 1, said beveling 21 extending in the insertion direction of the cable eyes 20 up to the side of the fixed clamping plate 1 facing the movable clamping plate 5.

When a cable eye 20 is clamped in the terminal, solely the threadless neck 18 of the clamping screw 14 is in the area of the taphole 15 of the flat clamping element 9, whereas the thread of the clamping screw 14 engages the taphole 16 of the fixed clamping plate 1, causing the cable eye 20 to be clamped, as desired.

Figure 6:
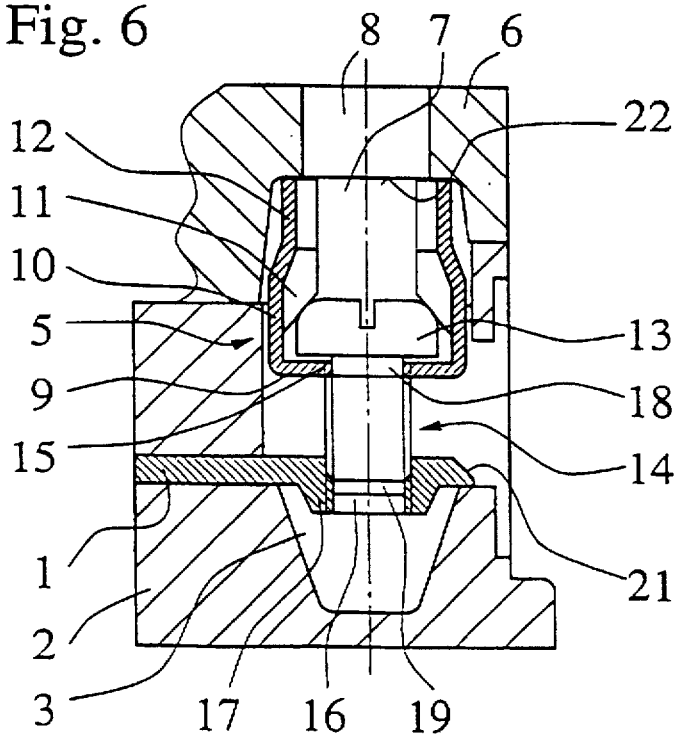
FIG. 6 shows a terminal according to FIGS. 1 through 3 while opening.

In order to open the terminal, the clamping screw 14 is simply screwed out. As can be seen in FIG. 6, the movable clamping plate 5 thereby rests on that end of the thread which lies closer to the screwhead 13, and the movable clamping plate 5 moves relative to the base 22 of the clearing 7 of the cover 6 until it rests against the base 22 of the clearance 7 with its tongues 10.

If the screw 14 is turned further, its thread engages the taphole 15 of the movable clamping plate 5, and the clamping screw 14 can be screwed out of the movable clamping plate 5 until only its threadless end section 19 penetrates the taphole 15, as it is shown in FIG. 1 and FIG. 2.

As soon as the thread of the clamping screw 14 is disengaged from the taphole 16 of the fixed clamping plate 1, the movable clamping plate 5 begins to sink back toward the fixed clamping plate 1. Eventually, the thread of the clamping screw 14 also disengages the taphole 15 of the movable clamping plate 5, and the cable eye 20 can be removed from the terminal, the free end of the shaft of the clamping screw 14 either being coplanar with the surface of the movable clamping plate 5 which faces the fixed clamping plate 1, or remaining within the taphole 15.

The the head 13 of the clamping screw 14 is already held by the spring tongues 10 of the movable clamping plate 5 and can therefore not fall out of the terminal.

Generally, the terminal can be mounted in such a way that the movable clamping plate 5 always lies above the fixed clamping plate 1. In this case, the clamping plates 1, 5 remain separated in the open state of the terminal, the movable clamping plate 5 thereby resting with its tongues 10 on the base 22 of the clearance 7 of the cover 6. The screw 14 is thereby securely prevented from falling out of the terminal through the frictional connection between its head 13 and the spring tongues 10 of the movable clamping plate 5. In such a mounting position of the terminal, the clamping screw 14 preferably runs sloping upward viewed from its head 13.

It is furthermore possible to dimension the clearance 7 of the cover 6 in such a way that a friction contact occurs between the tongues 10 of the movable clamping plate 5 and the walls of the clearance 7 in a position of the clamping plate 5 where it adjoins substantially to the base 22 of the clearance 7, the movable clamping plate 5 being held in this position as a result. With such a matching of the cover 6 and the movable clamping plate 5, the clamping screw 14 has to be screwed only a small way out of the clamping plate 5 after reaching the position in which the movable clamping plate 5 adjoins to the base 22 of the clearance 7, the base 22 serving as a stop limiting the opening width of the clamping plates 1, 5. The screw 14 can thereby remain engaged with the taphole 15. In this case, only a gap which is sufficiently wide to allow the insertion or the removal respectively of a cable eye has to remain between the fixed clamping plate 1 and the free end of the screw 14.

What is claimed is:

1. A screw terminal for an electrical connection of an eye of a cable, the terminal comprising (a) a casing having a longitudinal axis, (b) a first clamping plate axially movably but not rotatably mounted in the casing, the axial movement of the first clamping plate being limited by an inner surface of the casing, the first clamping plate defining a taphole and comprising (1) laterally bent up spring tongues, (c) a second clamping plate fixedly mounted in the casing, (1) the second clamping plate defining a taphole axially aligned with the taphole in the first clamping plate, and (d) a clamping screw for axially moving the first clamping plate between a closed position and an open position limited by the inner casing surface wherein the space between the first clamping plate and the second clamping plate has a maximum axial length, the clamping screw comprising (1) a screwhead held in the open position between the spring tongues of the first clamping plate and (2) an axially extending shaft passing first through the taphole of the first clamping plate and then through the taphole of the second clamping plate in the closed position, the shaft comprising a threaded section engaging the tapholes, the maximum axial length of the space between the first clamping plate and the second clamping plate being smaller than an axial length of the threaded section, a constricted neck between the screwhead and the threaded section, the neck having an axial length at least equal to the thickness of the first clamping plate, and a threadless free end having a diameter smaller than the diameter of the tapholes and an axial length not exceeding the thickness of the first clamping plate.

2. The screw terminal of claim 1, comprising a pair of said spring tongues, the spring tongues having circularly arcuate free ends.

3. The screw terminal of claim 1, wherein the second clamping plate has a beveled side facing the first clamping plate.

* * * * *